US005220949A

United States Patent [19]

Rufenacht

[11] Patent Number: 5,220,949

[45] Date of Patent: Jun. 22, 1993

[54] BOTTLE REFLLING APPARATUS

[75] Inventor: Rudolf Rufenacht, Dulliken, Switzerland

[73] Assignee: Chesebrough-Pond's USA Co., Greenwich, Conn.

[21] Appl. No.: 720,984

[22] Filed: Jun. 25, 1991

[30] Foreign Application Priority Data

Jun. 26, 1990 [GB] United Kingdom ..... 9014236

[51] Int. Cl.[5] ..... B65B 1/04; B65B 29/00

[52] U.S. Cl. ..... 141/285; 141/308; 141/2; 141/300

[58] Field of Search ..... 141/285, 308, 309, 297, 141/298, 299, 300, 364, 366, 31, 306, 319, 320, 348, 349, 2

[56] References Cited

U.S. PATENT DOCUMENTS

| | | | |
|---|---|---|---|
| 1,083,183 | 12/1913 | Bednarowicz | 141/285 |
| 1,941,304 | 12/1933 | Heylandt | 141/285 |
| 3,156,272 | 11/1964 | Indrunas | 141/319 |
| 3,595,279 | 7/1971 | Jaffe | 141/2 |
| 3,729,031 | 4/1973 | Baldwin | 141/2 |
| 3,729,032 | 4/1973 | Tischlinger et al. | 191/2 |
| 3,885,607 | 5/1975 | Peltier | 141/329 |
| 4,373,559 | 2/1983 | Mowles et al. | 141/309 |
| 4,475,914 | 10/1984 | Portnoff | 141/304 |
| 4,969,491 | 11/1990 | Kiplinger | 141/1 |
| 5,127,118 | 7/1992 | Johenning | 141/382 |

FOREIGN PATENT DOCUMENTS

| | | |
|---|---|---|
| 8612169 | 10/1986 | Fed. Rep. of Germany . |
| 8815123 | 3/1989 | Fed. Rep. of Germany . |
| 98058 | 2/1993 | Switzerland . |
| 350937 | 3/1930 | United Kingdom . |
| 752995 | 10/1954 | United Kingdom . |
| 1220416 | 7/1968 | United Kingdom . |
| 1368412 | 4/1973 | United Kingdom . |

*Primary Examiner*—Henry J. Recla
*Assistant Examiner*—David J. Walczak
*Attorney, Agent, or Firm*—Milton L. Honig

[57] ABSTRACT

A refill system for a viscous liquid such as a shampoo or shower gel comprises a nozzle attached to a flexible pouch, the nozzle being capable of fitting inside a bottle and allowing air to vent from the bottle to atmosphere as the liquid passes into the bottle through the nozzle.

7 Claims, 2 Drawing Sheets

BOTTLE REFLLING APPARATUS

FIELD OF THE INVENTION

The present invention relates to a device for filling bottles with gels or other viscous liquids. More particularly the invention discloses a refill pouch and spout for refilling containers with a gel, such as a shampoo or shower gel.

THE RELATED ART

Most containers for cosmetic products such as shower gels and shampoos are purchased in disposable rigid or semi-rigid containers such as plastic or, less usually, glass bottles. Often these are decorated so as to blend in with bathroom fittings if left out in the open. However, there has been growing pressure that less wasteful methods of packaging be used. Although plastics can be employed which decompose on exposure to sunlight, the decomposition process is quite slow. Furthermore, if the multi-dose bottles are stored in daylight, the bottle can break down whilst still in use.

There has been an increasing use of refill containers for domestic products. The consumer purchases an initial bottle of the relevant product such as fabric conditioner. Once this is used up, the bottle is retained and a refill pouch of liquid purchased. The refill pouch is usually made of a thin, degradable plastics or waxed paper material. The contents of the pouch are then emptied into the much more rigid original bottle and the pouch is thrown away. The bottle can be used again and again with a resultant decrease in plastics material used and litter generated.

The system described works very well for very thin liquids having a viscosity approximating to water, or even a little more viscous. However, problems arise if thicker liquids such as gels are employed. Bottles are refilled by the consumer via the dispensing spout which may be a relatively restricted orifice. Pouch refill packs are often opened by cutting with a knife or scissors. The high viscosity of gels such as shampoos or shower soaps means that it is difficult to pour the gel into the closed bottle from the cut pouch. Gel globules can stick in the bottle orifice to form a plug, past which air escaping from the filling bottle can not pass. Gel is thereby prevented from entering the bottle and overflows.

A solution proposed to this problem is the incorporation of a nozzle on the refill pack. However, although the nozzle may prevent blockage of the bottle orifice as gel is squeezed out of the pouch, if the pouch is squeezed too hard excess gel escapes and overflows the bottle. A tight fitting nozzle creates a closed system from which air forced out of the bottle can not escape.

Overall, particular problems are observed in trying to decant a not totally free flowing liquid such as a gel from one package having a dispensing nozzle to another. When the first package initially containing the gel-like substance is a flexible package such as a plastics pouch, the problem is observed not so much in dispensing the gel from the flexible package initially, since the user can exert a physical pressure on the outside of the flexible package, and because of its collapsible nature there is no need for air to flow back into the flexible package to replace the dispensed gel. However, especially when the bottle being refilled is rigid or semi-rigid, and additionally where it is desirable to hold the nozzle of the flexible package adjacent to, and even in an effectively airtight communication with, the open neck of the bottle being refilled (as is often the case, both for ease of handling for the user, and also to minimise the possibility of spillage), problems in effecting the decanting operation are observed due to the difficulty of providing an escape route for air initially contained in the rigid bottle but displaced by the fluid. This problem to particularly acute when the fluid being decanted is of a gel-like nature, such as with shower gels and shampoos.

A further problem with such systems is that it is possible to over-fill the bottle being refilled, and cause a spillage of gel out through the neck of the bottle being filled. This problem is particularly so if for any reason the fluid level in the bottle being filled cannot be seen, such as for example if the bottle being refilled has opaque walls.

It is therefore an objection of the invention to alleviate the problems of the prior art.

SUMMARY OF THE INVENTION

Thus, according to the present invention there is provided an apparatus for containing and dispensing a viscous liquid comprising a flexible liquid reservoir in airtight connection with a nozzle discharging said liquid, said nozzle comprising an opening defined by a wall, wherein said wall comprises one or more air discharge passageways such that insertion of the nozzle into a corresponding aperture in a second closed liquid reservoir allows liquid to flow from said flexible reservoir to said second reservoir and air to be discharged from said second reservoir into the atmosphere via the passageways.

Preferably, the nozzle attached to the flexible reservoir is adapted to form a substantially airtight connection with the second closed reservoir to be filled.

It is preferred that the air discharge passageways, which may be in the form of holes or channels, are of such dimensions or diameter such that when the level of liquid dispensed from the first reservoir reaches the open end of the nozzle when inserted into the second reservoir, no more liquid passes from the first reservoir to the second reservoir because the air discharge passageways are blocked by the liquid, thus preventing liquid from the second reservoir flowing into them during dispensing.

The invention is suitable for liquids having a viscosity of 1000–5000 c.P., more preferably 1500–4500 c P. (25° C.) such as, but not by limitation, shower gels and shampoos. As such the invention also comprises a package as previously described additionally containing a viscous liquid.

BRIEF DESCRIPTION OF THE DRAWING

A specific embodiment of the invention will now be described by way of example and with reference to the accompanying drawings in which.

DETAILED DESCRIPTION

Figure 1:
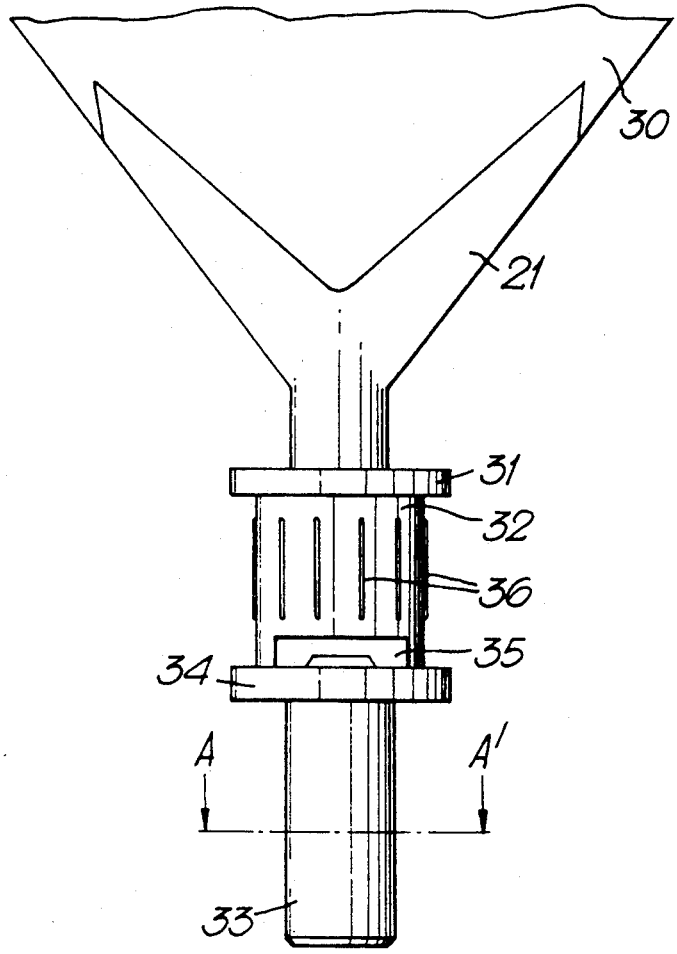
FIG. 1 is a side elevation of the refill device according to the invention
Figure 2:
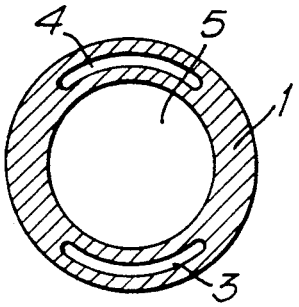
FIG. 2 is a cross section through the nozzle along the line AA' of FIG. 1

In FIG. 2 of the drawings, there is shown a cross section through the nozzle 33 along the line AA' shown in FIG. 1. Nozzle 33 is defined by a wall 1. Two passageways 3, 4 pass inside the wall. The passageway 5 is in connection with the flexible fluid reservoir 30.

Figure 3:
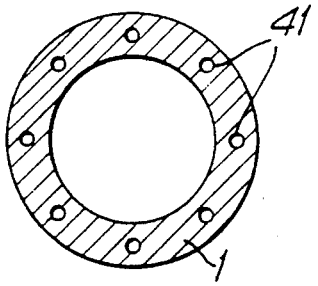
FIG. 3 is a cross section of a second form of nozzle along the line AA' of FIG. 1
Figure 4:
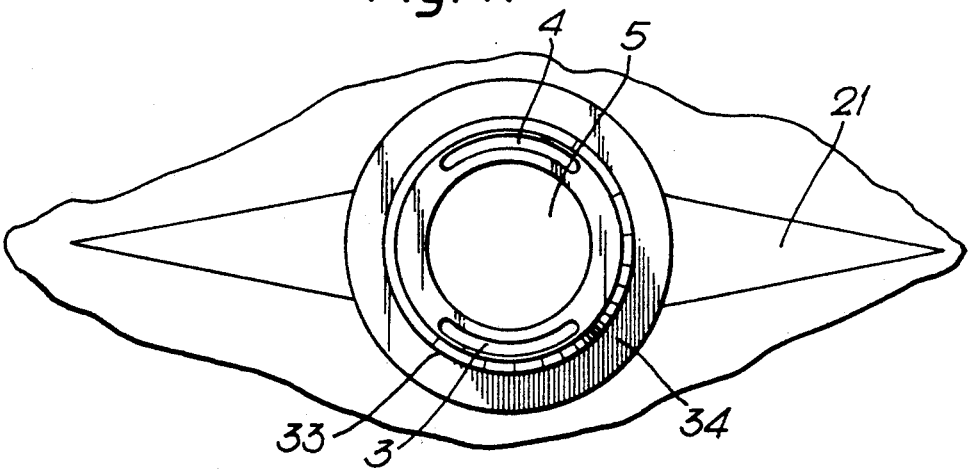
FIG. 4 is a plan view of the nozzle from below

In FIG. 3, an alternative construction is shown. Instead of two passageways 3, 4 a number of holes 41 of diameter 0.8 mm are bored inside the wall 1.

FIG. 1 shows a side elevation of the refilling device according to the invention. The fluid to be dispensed is contained in flexible fluid reservoir 30, which has attached to its body walls in one corner by known techniques such as welding a more rigid moulded corner connecting piece 21. Fluid reservoir 30 and corner connecting piece 21 are conveniently manufactured from plastics materials. The fluid contained in reservoir 30 is a gel of viscosity 3000 c.P.

Firmly fixed to connecting piece 21 is a first encircling ring 31, also of rigid plastics materials. Ring 31 can be connected to connecting piece 21 for example by screwing it on, if connecting piece 21 and ring 31 are provided with the appropriate screw threads. Nozzle 33 is provided with a second encircling rim 34. First and second encircling rims 31 and 34 are attached through a housing part 32. Housing 32 is provided with ribs 36. Viewing FIG. 2 in conjunction with FIG. 1, in use air passes along air passage ways 3, 4 (not shown in FIG. 1) and vents into the atmosphere through outlet 35. Also in use, liquid or gel from flexible reservoir 30 passes though passage way 5 of nozzle 33, and into a second reservoir. The operation of the device and system is described in more detail in conjunction with other figures.

When used with a typical shower gel formulation, it has been found that nozzle 33 conveniently has a diameter of passage way 5 of 6 mm, through which fluid can flow from flexible reservoir 30. Air passageways 3,4 circumferentially each comprise 90° of the nozzles circumference, and have an internal radius of 4.0 mm and an external radius of 4.75 mm, thus being 0.75 mm across.

Figure 5:
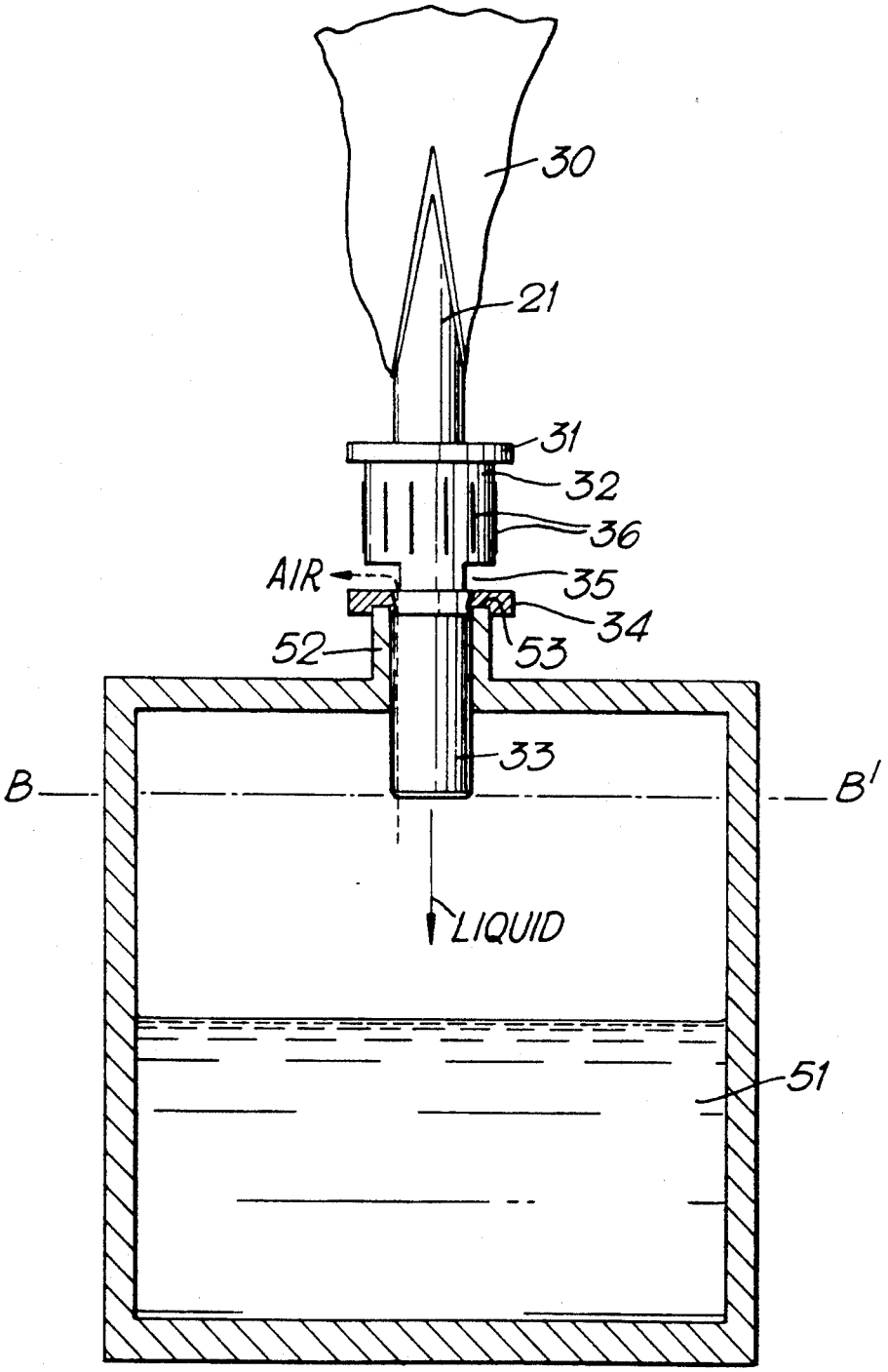
FIG. 5 is a cross section showing the operation of the system described.

With particular reference to FIG. 5, in use nozzle 33 fits into the open neck 52 of the second reservoir 51, and is pushed down until the rim 34 connects tightly with the rim 53 of the neck. Apart from the passageways 3, 4 the system of the two reservoirs and the nozzle is now airtight.

The nozzle 33 is also provided with a second encircling rim 31. This enables the user to grip the nozzle to remove it from the second reservoir 51.

In storage, a stopper may be removably attached to the end of the nozzle 33 to prevent accidental discharge of liquid contained within the reservoir 30.

The method of use of the filling system will now be described. When completely or partially emptied, it is desired to refill the second reservoir 51, for example a bottle. The nozzle 33 is inserted into the neck 52 of the bottle and pressed down until the rim 34 engages with rim 53. The reservoir 30 is then pressed, causing liquid to pass through the nozzle passageway 5 into the bottle. Gradually the level of liquid in the bottle rises. At the same time, air displaced by the liquid from the bottle passes through the passageways 3, 4 and vents into the atmosphere through the outlets 35. When the level of liquid is at BB' as shown in FIG. 5, the two air passages 3, 4 are blocked. Air can no longer escape and as a consequence the flow of liquid into the bottle ceases. The nozzle 33 is removed, and excess liquid remaining in the nozzle portion flows back into the reservoir 30.

It will be understood that the refill reservoir 30 may contain sufficient liquid such that it contains a plurality of refill doses for the re-usable bottle, and may contain for example 500 ml or 1000 ml of gel.

The nozzle piece 33 may be made of any suitable material, but a mouldable plastics material is preferred.

It will be understood that the foregoing description is that of a preferred embodiment of the invention and various changes and modifications may be made thereto without departing from the scope of invention as defined in the claims.

What is claimed is:

1. An apparatus for containing and dispensing a viscous liquid adapted to be conveyed to a closed liquid reservoir having an inlet aperture, the apparatus comprising:
   - a flexible liquid reservoir; and
   - a nozzle defining a flow passage having one end thereof in airtight connection to said flexible liquid reservoir and an opposite end, said nozzle including:
     - a cylindrical wall adjacent said opposite end terminating in an opening for discharging said liquid and having a sufficient length to extend into said inlet aperture; and
     - at least one passageway for discharging air such that insertion of said nozzle into said inlet aperture of said closed liquid reservoir allows liquid to flow from said flexible reservoir to said closed reservoir via said opening and air to be discharged from said closed reservoir into the atmosphere via said passageway, said at least one passageway extending along said length of said wall and being formed therewithin.

2. An apparatus according to claim 1 wherein said nozzle is adapted to form a substantially airtight connection with said closed liquid reservoir.

3. An apparatus according to claim 1 wherein said at least one passageway is of such dimensions so as to prevent liquid from said closed reservoir flowing into said passageways during dispensing.

4. An apparatus according to claim 8 containing a viscous liquid.

5. An apparatus according to claim 4 wherein the liquid has a viscosity of 1000–5000 c.P.

6. An apparatus according to claim 5 wherein the liquid has a viscosity of 1500–4500 c.P.

7. An apparatus according to claim 1 wherein the apparatus is manufactured from plastic materials.

* * * * *